US008674230B2

(12) United States Patent
Hoxha

(10) Patent No.: US 8,674,230 B2
(45) Date of Patent: Mar. 18, 2014

(54) WAVE GRIPPING CORE SLEEVE

(75) Inventor: Vladimir Hoxha, Scarborough (CA)

(73) Assignee: Hubbell Incorporated, Shelton, CT (US)

( * ) Notice: Subject to any disclaimer, the term of this patent is extended or adjusted under 35 U.S.C. 154(b) by 224 days.

(21) Appl. No.: 13/233,758

(22) Filed: Sep. 15, 2011

(65) Prior Publication Data

US 2013/0068501 A1 Mar. 21, 2013

(51) Int. Cl.
*H01B 7/00* (2006.01)

(52) U.S. Cl.
USPC ..... 174/135; 174/84 R; 174/78; 174/79; 174/92; 174/84 S

(58) Field of Classification Search
USPC ..... 174/135, 79, 84 R, 84 S
See application file for complete search history.

(56) References Cited

U.S. PATENT DOCUMENTS 3,205,300 A * 9/1965 Becker ..... 174/84 S
3,384,704 A 5/1968 Vockroth
3,624,270 A 11/1971 Turner
3,814,836 A 6/1974 Neale, Sr.
3,826,860 A * 7/1974 De Sio et al. ..... 174/73.1
4,079,189 A 3/1978 Troccoli
4,889,022 A * 12/1989 Peviani ..... 81/368
7,319,194 B2 1/2008 Bryla
7,547,846 B2 * 6/2009 Lallouet et al. ..... 174/84 R
7,658,655 B2 2/2010 Waltz
2007/0062718 A1 * 3/2007 De France ..... 174/84 C
2008/0233787 A1 * 9/2008 Geibel et al. ..... 439/312

OTHER PUBLICATIONS

International Search Report issued in PCT/US2012/054778 dated Nov. 28, 2012.

* cited by examiner

*Primary Examiner* — Hoa C Nguyen
*Assistant Examiner* — Paresh Paghadal
(74) *Attorney, Agent, or Firm* — Marcus R. Mickney; Mark S. Bicks; Alfred N. Goodman

(57) ABSTRACT

A wave gripping core sleeve for containing compression or crimping energy in bare conductor transmission power lines in full tension joints or dead end joints. The wave gripping core sleeve includes a plurality of interlocking members having a first end and a second end with a groove adjacent at least one of the ends. The first side of each interlocking member is engaged with the second side of an adjacent interlocking member. At least one resilient member wraps around the circumference of the interlocking members and is received in a channel formed by the aligned grooves. The interlocking members include a first set of ribs to engage the conductor in a first direction and a second set of ribs to engage the conductor in a second direction, opposite from the first direction.

20 Claims, 12 Drawing Sheets

WAVE GRIPPING CORE SLEEVE

FIELD OF THE INVENTION

The present invention relates to a device for containing compression or crimping energy in bare conductor transmission power lines in full tension joints or dead end joints. The wave griping core sleeve includes a plurality of interlocking members having first and second ends, a groove disposed adjacent at least one of the ends, and a first side with a longitudinally projecting wing and a second side with a receptacle for receiving the wing of an adjacent interlocking member. A biasing means wraps around the interlocking members and is received in the channel formed by the aligned grooves extending around the circumference of the wave gripping core sleeve.

BACKGROUND OF THE INVENTION

Implosive technology is used for installing transmission connectors by utility contractors to connect overhead high voltage transmission lines. Implosive energy compresses the connectors. In existing implosive technology, a steel sleeve core is disposed around the conductor and implosive energy is harnessed in a precisely engineered manner to produce a carefully controlled compression of the steel core.

Existing steel sleeve cores used in implosion technology have many problems including high stiffness, high requirements for implosive energy, and the possibility of energy loss between the sleeve slots.

A need exists for a wave gripping core sleeve for keeping the assembly together during compression while accommodating a variety of conductor core diameters.

SUMMARY OF THE INVENTION

Accordingly, an object of the invention is to provide a wave gripping core sleeve having a plurality of interlocking members held biased together.

Another object of the invention is to provide a wave gripping core sleeve having a plurality of ribs along the interlocking members, wherein first and second interlocking members have a first set of aligned ribs and third and fourth interlocking members have a second set of aligned ribs, and the first set of ribs are axially offset from the second set of ribs.

A further object of the invention is to provide a wave gripping core sleeve having a plurality of laterally sliding members for accommodating a variety of conductor core diameters.

Still another object of the invention is to provide a wave gripping core sleeve with a pre-loading position having a first diameter and a post-loading position having a second diameter smaller than the first diameter.

Yet another object of the invention is to provide a wave gripping core sleeve where the space between the plurality of interlocking members decreases after the conductor is loaded therein.

A further object of the invention is to provide a wave gripping core sleeve for deforming the conductor steel core in a wave shape during connector compression, thereby increasing the friction to more securely grip the conductor and resisting pullout tension.

Still another object of the invention is to provide a wave gripping core sleeve having a cavity formed by the first and second interlocking members that push the conductor steel core in a first direction.

Yet another object of the invention is to include a plurality of stopping ribs along the external surface of the plurality of interlocking members to secure bonding with the aluminum sleeve of the joint assembly.

The foregoing objects are basically attained by providing a wave gripping core sleeve having a cavity formed by the third and fourth interlocking members that push the conductor steel core in a second direction, opposite from the first direction of the first and second interlocking members.

By forming the wave gripping core sleeve in this manner, a conductor steel core is deformed in a wave shape during connector implosion (see e.g., U.S. patent application Ser. No. 12/046,122 to Geibel et al. which is hereby incorporated by reference in its entirety). The biasing means, or garter springs, keep the assembly together as one unit and allow the plurality of interlocking members to slide laterally to each other while accommodating different conductor steel cores.

As used in this application, the terms "top", "bottom", and "side" are intended to facilitate the description of the wave gripping core sleeve, and are not intended to limit the description of the wave gripping core sleeve to any particular orientation.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

The above aspects and features of the present invention will be more apparent from the description of the exemplary embodiments of the present invention taken with reference to the accompanying drawing figures, in which.

Throughout the drawings, like reference numerals will be understood to refer to like parts, components and structures.

DETAILED DESCRIPTION OF THE INVENTION

Figure 1:
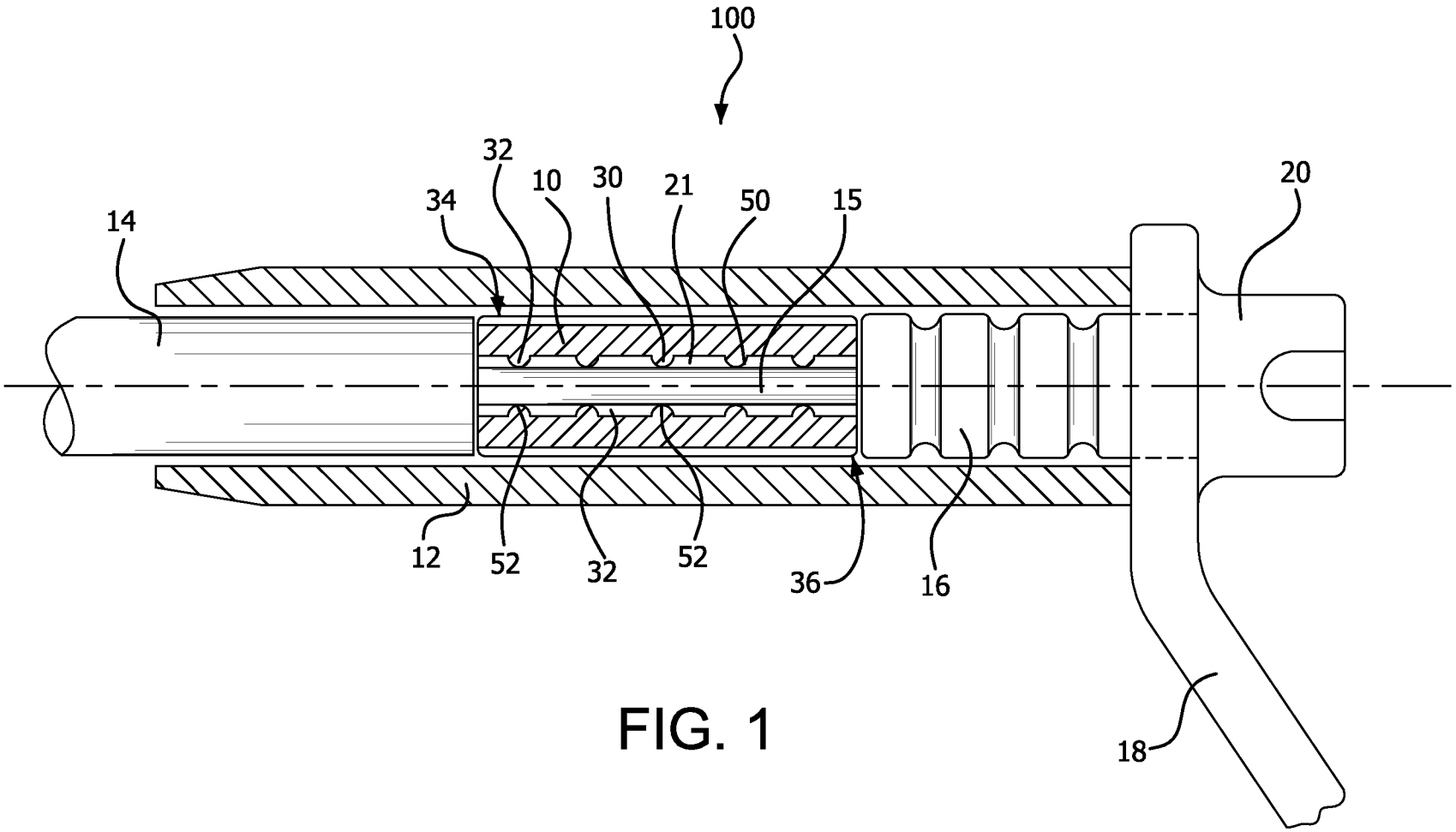
FIG. 1 is a side elevational view in section of an implosion dead end joint assembly having a wave gripping core sleeve according to a first exemplary embodiment of the present invention.
Figure 2:
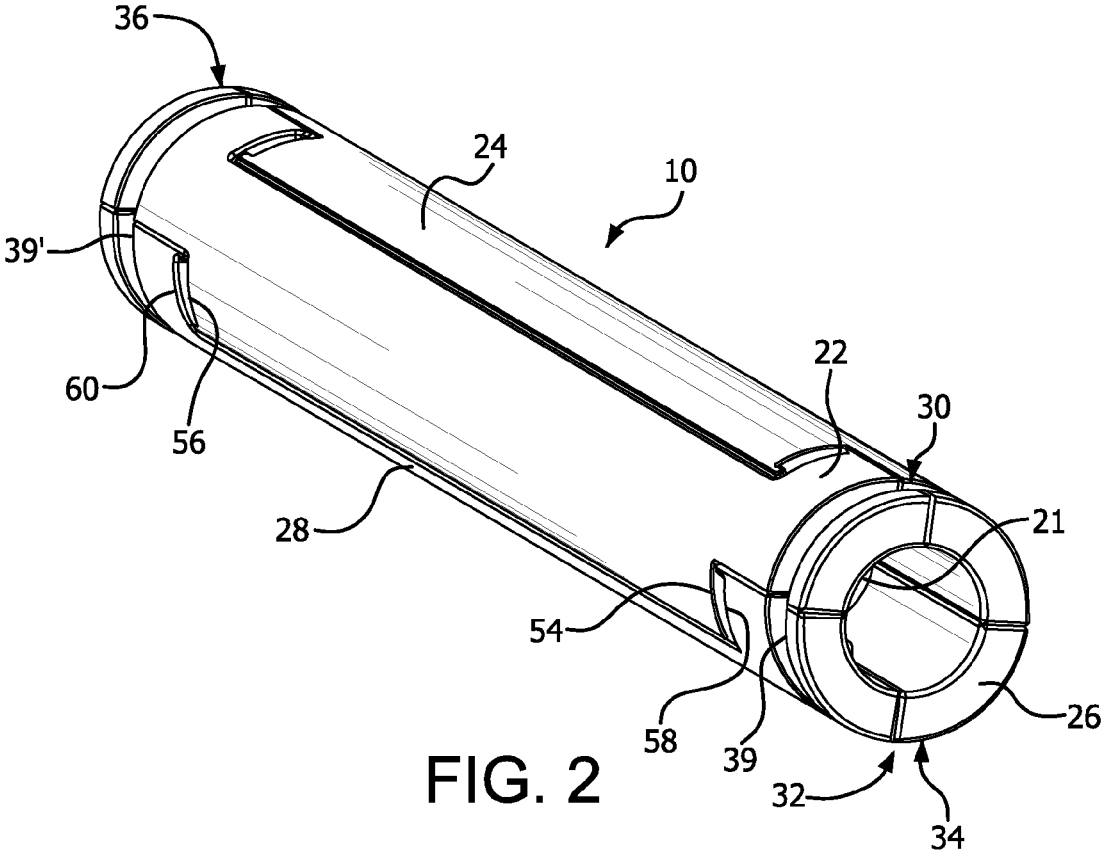
FIG. 2 is a front perspective view of the wave gripping core sleeve illustrated in FIG. 1.
Figure 3:
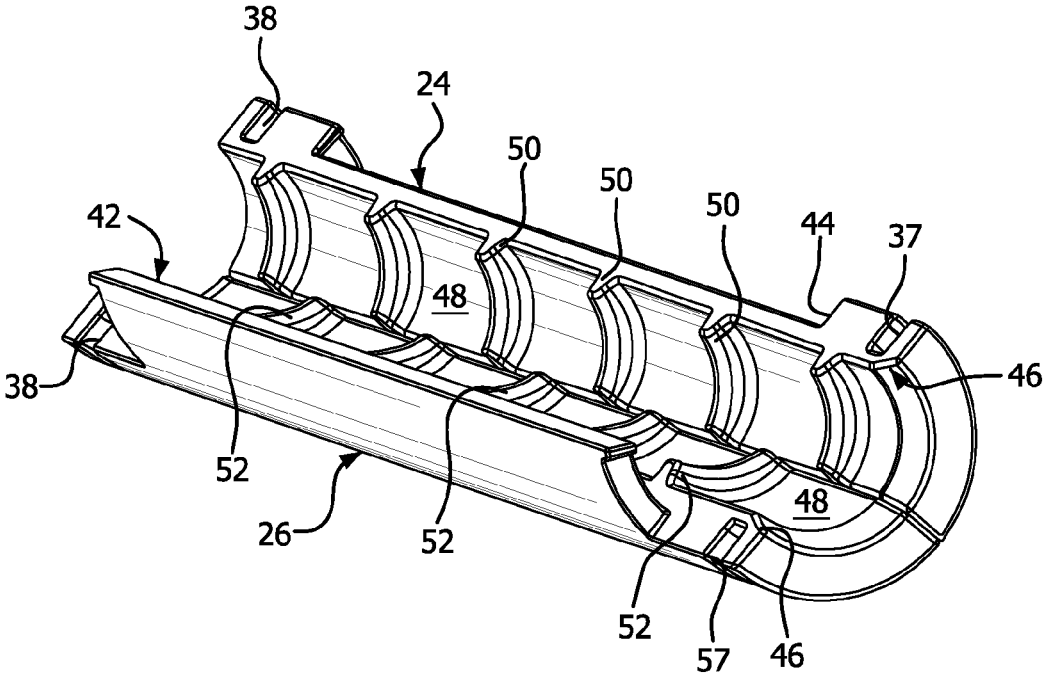
FIG. 3 is a front perspective view of the interior surface of two interlocking members of the wave gripping core sleeve of FIGS. 1 and 2.

A wave gripping core sleeve 10 can be used with bare conductor transmission lines in full tension joints or dead end joints. For purposes of explanation and by way of example only, the wave gripping core sleeve 10 will be described with respect to an implosion dead end joint assembly 100, as shown in FIG. 1. The implosion dead end joint assembly 100 includes a splice 12 surrounding the wave gripping core sleeve 10, which is axially between a conductor 14 and a round or oval end connector 16, such as an eyebolt.

The eyebolt 16 is attached to a main sleeve 20 and can be freely turned to the desired position relative to a T-tap or NEMA pad 18 prior to initiation. The NEMA pad 18 is preferably welded to the main sleeve 20 and connected to an external jumper terminal (not shown). The NEMA pad 18 can be substantially planar, or angled as shown in FIG. 1. The splice 12 has a pre-mounted implosive charge.

The wave gripping core sleeve 10 includes a plurality of steel, forged parts or interlocking members 22, 24, 26, 28, each having a curved body, as shown in FIGS. 2-6. When the interlocking members 22, 24, 26, 28 are disposed adjacent one another, they form a substantially right circular cylindrical sleeve having a main cavity 21 for receiving the conductor steel core 15. Each of the interlocking members 22, 24, 26, 28 includes a first end 34 disposed adjacent the conductor 14 and a second end 36 disposed adjacent the eyebolt 16.

Each of the interlocking members 22, 24, 26, 28 includes a first side wall and a second side wall. The first side wall is defined by a laterally projecting wing 42 extending longitudinally between the first end 34 and the second end 36 of the interlocking members 22, 24, 26, 28. The second side wall is defined by a receptacle 44 extending longitudinally between the first end 34 and the second end 36 of the interlocking members 22, 24, 26, 28. Both the wing 42 and the receptacle 44 are substantially rectangular with their respective longitudinal axes being parallel to the longitudinal axis of each respective interlocking member 22, 24, 26, 28.

When the interlocking members 22, 24, 26, 28 are connected, they are attached such that the first side wall or wing 42 of a first interlocking member 22 engages the second side wall or receptacle 44 of a second interlocking member 24. Subsequently, each wing 42 of one interlocking member is received in the receptacle 44 of the adjacent interlocking member. The second interlocking member 24 is similarly connected to the third interlocking member 26 and the third interlocking member 26 is similarly connected to the fourth interlocking member 28. Also, the wing 42 of the fourth interlocking member 28 is connected to the receptacle 44 of the first interlocking member 28, completing the cylindrical shape of the wave gripping core sleeve 10 to form the main cavity 21.

The structure of the wings 42 and receptacles 44 prevent relative axial movement of the interlocking members 22, 24, 26, 28. The first end 54 and second end 56 of each wing 42 abut the first end 58 and second end 60 of each receptacle 44. The wing ends 54, 56 are parallel to the receptacle ends 58, 60 and are received therebetween. Thus, the receptacle ends 58, 60 prevent the wings 42 from moving laterally once the interlocking members 22, 24, 26 28 are connected.

Figure 11:
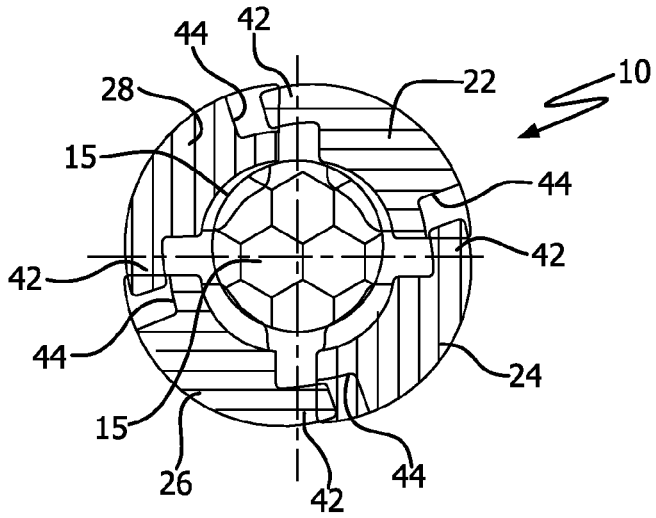
FIG. 11 is a front sectional view in section of the wave gripping core sleeve and conductor according to FIGS. 1-10 showing increased spacing between adjacent interlocking members to accommodate a conductor having a larger outer diameter.
Figure 12:
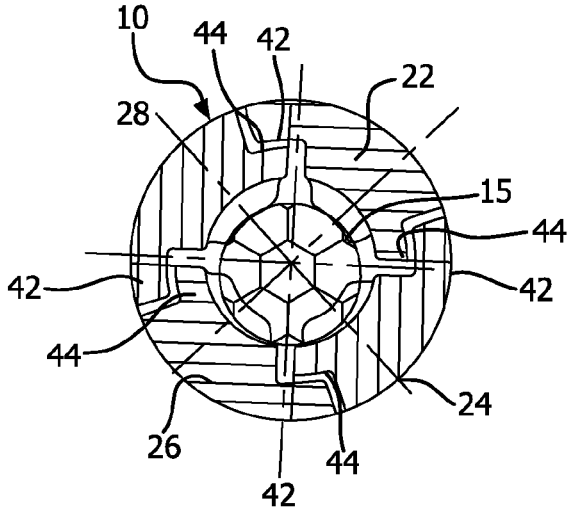
FIG. 12 is a front sectional view in section of the wave gripping core sleeve and conductor, after implosion, according to FIGS. 1-11, in which the ribs of the first and second interlocking members push the conductor downwardly.

By aligning the interlocking members 22, 24, 26, 28 in this manner, each wing 42 of one interlocking member is received in each receptacle 44 of the adjacent interlocking member. This connection also contributes to the ability of the wave gripping core sleeve 10 to accommodate different diameters of conductor steel cores 15 because, as shown in FIGS. 11 and 12, as the interlocking members 22, 24, 26, 28 move closer together after loading, the wings 42 are further received in the receptacles 44. Also, the interlocking members 22, 24, 26, 28 create a full steel sleeve core 10 with zero stiffness meaning the wave gripping core sleeve 10 accommodates a wide range of conductor steel cores 15.

Further, the exterior surface of each interlocking member 22, 24, 26, 28 includes a first groove 37 adjacent the first end 34 and a second groove 38 adjacent the second end 36. The grooves 37, 38 extend along the entire width of each interlocking member 22, 24, 26, 28, such that when the interlocking members 22, 24, 26, 28 are connected, the first groove 37 forms a continuous annular channel 39 around the circumference of the wave gripping core sleeve 10 adjacent the first end 34 and the second groove 38 forms a continuous annular channel 39' around the circumference of the wave gripping core sleeve 10 adjacent the second end 36.

Figure 10:
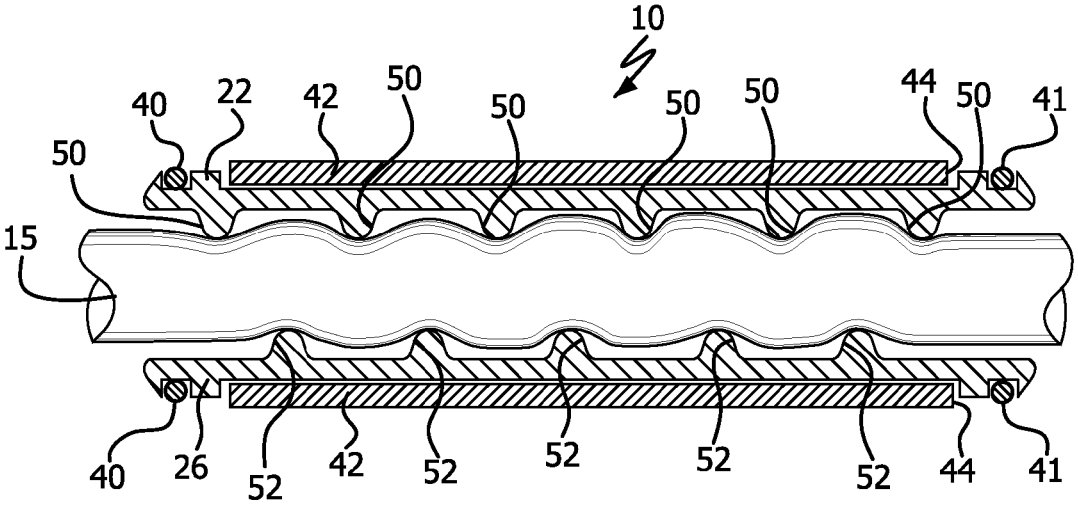
FIG. 10 is a side elevational view in section of the first and second semi-cylindrical members of the wave gripping core sleeve engaging the conductor, after implosion, according to FIG. 9.

When the interlocking members 22, 24, 26, 28 are connected to form the channels 39, 39', a biasing means or annular resilient member 40 (FIG. 5), such as a first garter spring, is placed around the wave gripping core sleeve 10 at the first end 34 and a second garter spring 41 is placed around the second end 36, as shown in FIG. 10. Those springs are respectively received in the channels 39, 39' formed by the grooves 37, 38. The garter springs 40, 41 are used as elastomeric extension springs, similar to rubber bands to keep the interlocking members 22, 24, 26, 28 connected to one another while allowing relative radial movement.

Figure 7:
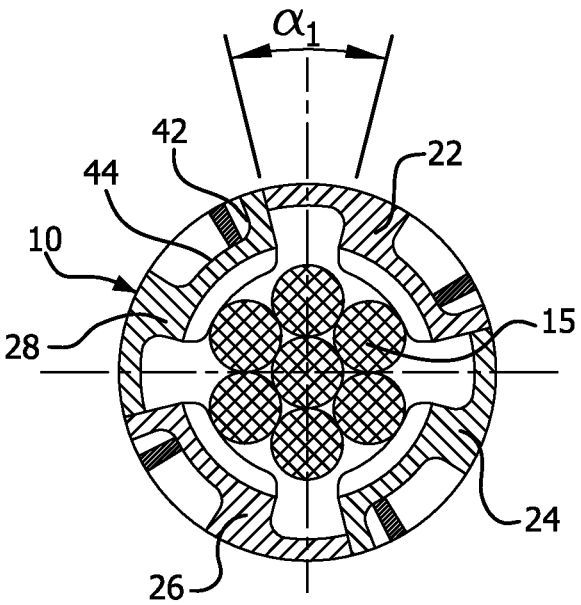
FIG. 7 is a front elevational view in section of the wave gripping core sleeve and conductor prior to being compressed, according to FIGS. 1-6.
Figure 8:
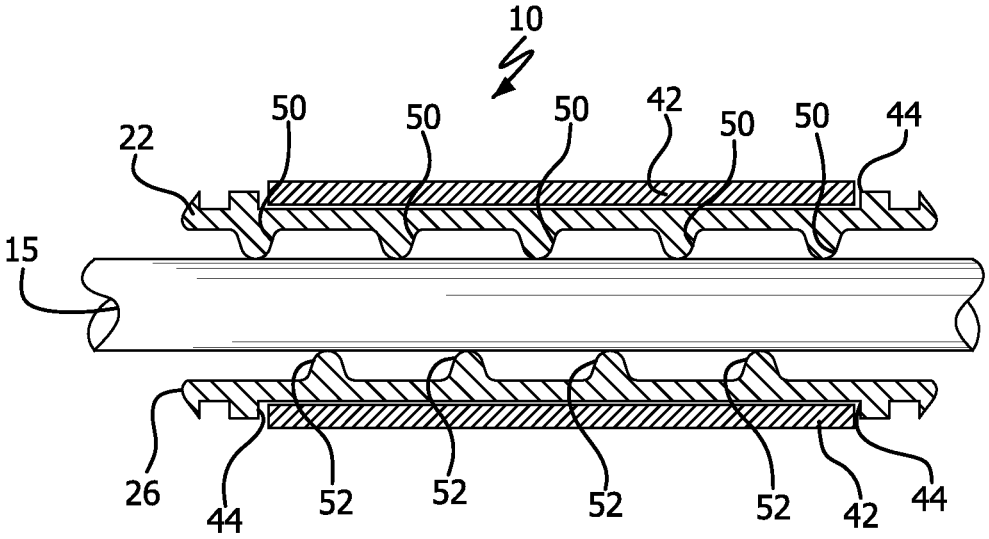
FIG. 8 is a side elevational view in section of the first and second semi-cylindrical members of the wave gripping core sleeve engaging the conductor, prior to implosion, according to FIG. 7.
Figure 9:
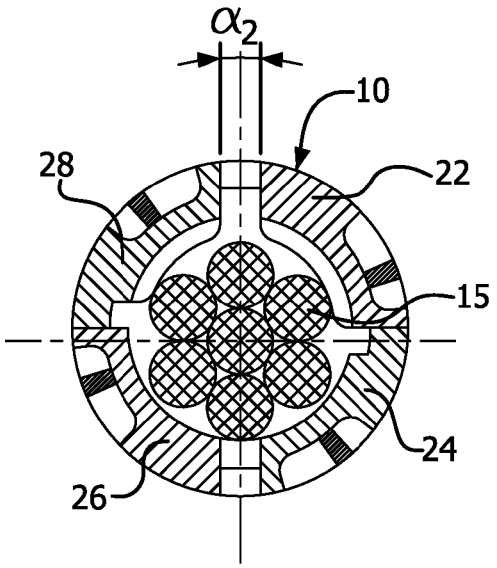
FIG. 9 is a front elevational view in section of the wave gripping core sleeve and conductor after implosion, according to FIGS. 1-8.

Before the garter springs 40, 41 are loaded into the channels 39, 39', the interlocking members 22, 24, 26, 28 are spaced apart a distance $\alpha 1$, as shown in FIG. 7, and the ribs 50, 52 are not fully engaging the conductor steel core 15, as shown in FIG. 8. Post loading, as shown in FIGS. 9 and 10, the ribs 50, 52 engage the conductor steel core 15 and the distance $\alpha 2$ between the adjacent members is less than the pre-loading distance $\alpha 1$.

With this configuration, the garter springs 40, 41 allow the interlocking members 22, 24, 26, 28 to slide laterally to each other and move radially, bringing the wings 42 and receptacles 44 together while accommodating conductor steel cores 15 of varying diameters. The distance between the wings 42 and receptacles 44 decreases when the garter springs 40, 41 are received in the channels 39, 39'. The distance between the wings 42 and receptacles 44 also changes depending on the diameter of the conductor steel cores 15 received by the interlocking members 22, 24, 26, 28.

Figure 5:
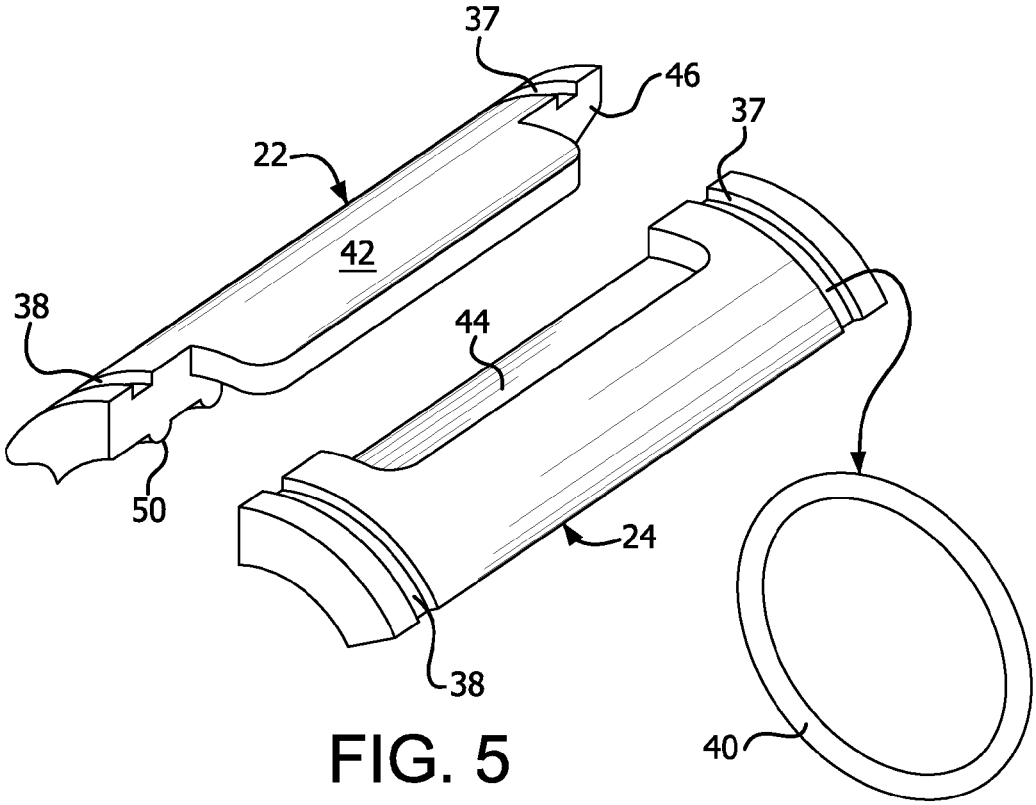
FIG. 5 is an exploded, front perspective view of two interlocking members of the wave gripping core sleeve of FIGS. 1-4.
Figure 6:
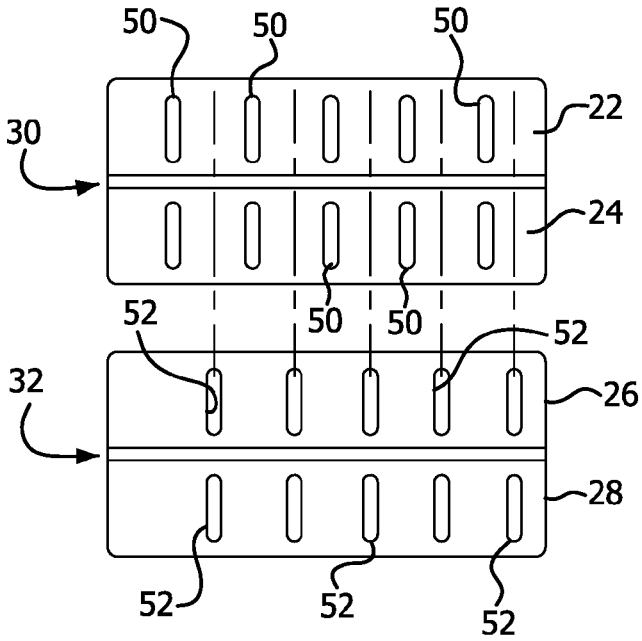
FIG. 6 is a top elevational view of the interior surfaces of four interlocking members of the wave gripping core sleeve of FIGS. 1-4, showing the offset orientation of the plurality of ribs when the first and second semi-cylindrical members are aligned.

As shown in FIG. 5, the interior surface of the interlocking members 22, 24, 26, 28 includes an angled wall or slope 46 disposed at the first end 34. Preferably, the angled wall 46 is on the opposite side of the first groove 37 to aid in the insertion of the conductor steel core 15.

When the interlocking members 22, 24, 26, 28 are connected to each other, the first interlocking member 22 and the second interlocking member 24 form a first semi-cylindrical member 30 and the third interlocking member 26 and the fourth interlocking member 28 form the second semi-cylindrical member 32. The interlocking members 22, 24 of the first semi-cylindrical member 30 include a plurality of semi-annular ribs 50 along their interior surface. The interlocking members 26, 28 of the second semi-cylindrical member 32 include a plurality of semi-annular ribs 52 along their interior surface. When the wave gripping core sleeve 10 is assembled and the interlocking members 22, 24, 26, 28 are connected, the ribs 50 of the first semi-cylindrical member 30 are offset from the ribs 52 of the second semi-cylindrical member 52 along the longitudinal axis of the wave gripping core sleeve 10.

The first semi-annular ribs 50 are offset from the second semi-annular ribs 52. As shown in FIGS. 8 and 10, the first semi-annular ribs 50 contact the conductor steel core 15 in a different position along the length of the conductor steel core 15 surface than the second semi-annular ribs 52.

Figure 13:
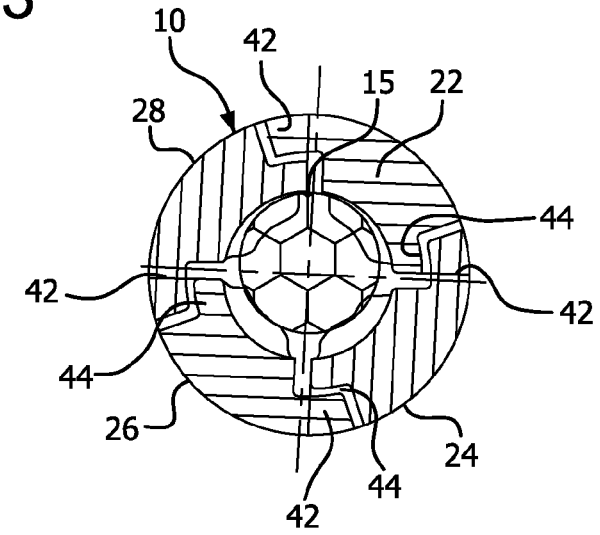
FIG. 13 is a front sectional view in section of the wave gripping core sleeve and conductor, after implosion, according to FIGS. 1-12, in which the ribs of the third and fourth interlocking members push the conductor upwardly.
Figure 15:
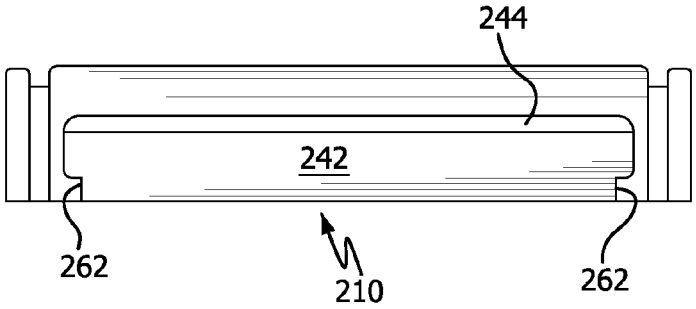
FIG. 15 is a side perspective view of the wave gripping core sleeve according to a third exemplary embodiment of the present invention.
Figure 16:
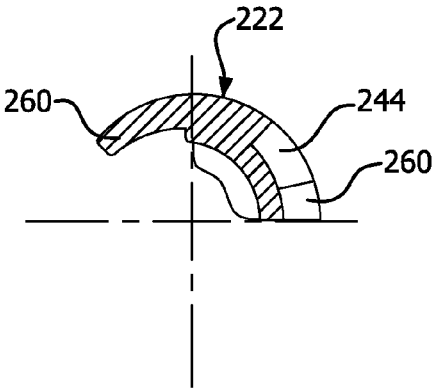
FIG. 16 is an end elevational view in section of the wave gripping core sleeve seen in FIG. 15 with a close up view of a wing and a receptacle.
Figure 17:
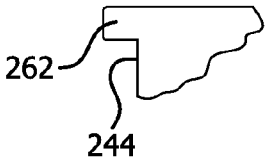
FIG. 17 is a partial view of the wing with the locking finger according to FIGS. 15 and 16.
Figure 18:
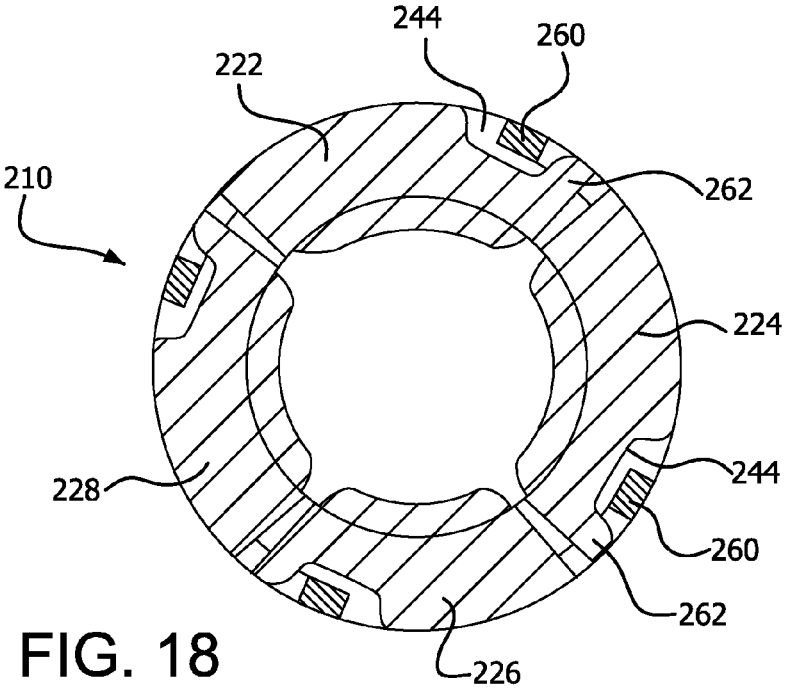
FIG. 18 is a sectional end elevational view of the wave gripping core sleeve illustrated in FIGS. 15-17 showing the connection between two wings and receptacles.
Figure 19:
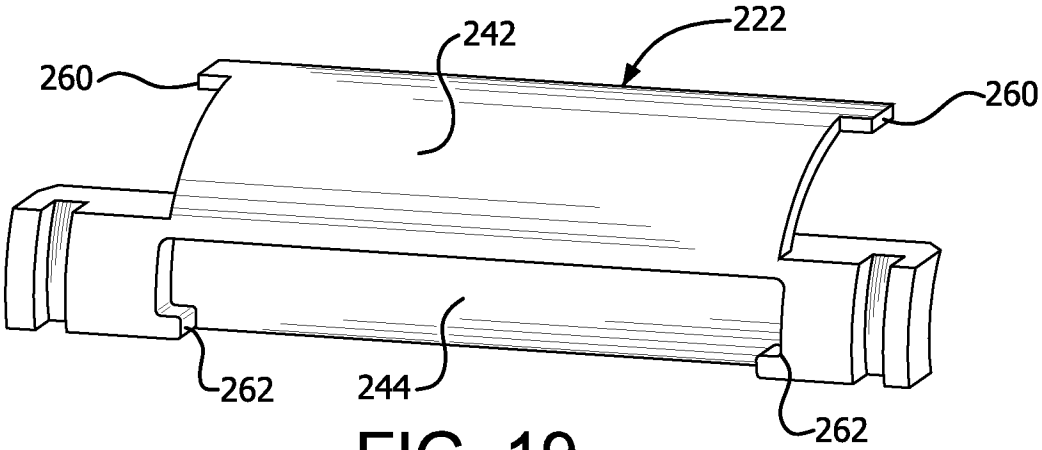
FIG. 19 is a perspective view of an interlocking member of the wave gripping core sleeve of FIGS. 15-18.

By forming the interlocking members in this manner, the ribs of the first semi-cylindrical member push the conductor steel core 15 downwardly while the ribs of the second semi-cylindrical member 32 push the conductor steel core 15 upwardly. This causes the conductor steel core 15 to deform in a wave shape during connector implosion. As shown in FIGS. 12 and 13, the wave deformation causes the top of the conductor steel core 15 to contact the upper surface of the wave gripping core sleeve 10 and the bottom of the conductor steel core 15 to contact the bottom surface of the wave gripping core sleeve 10. As such, the conductor steel core 15 is adjacent the first semi-cylindrical member 30 in FIG. 13 and the conductor steel core 15 is adjacent the second semi-cylindrical member 32 in FIG. 12.

Figure 14:
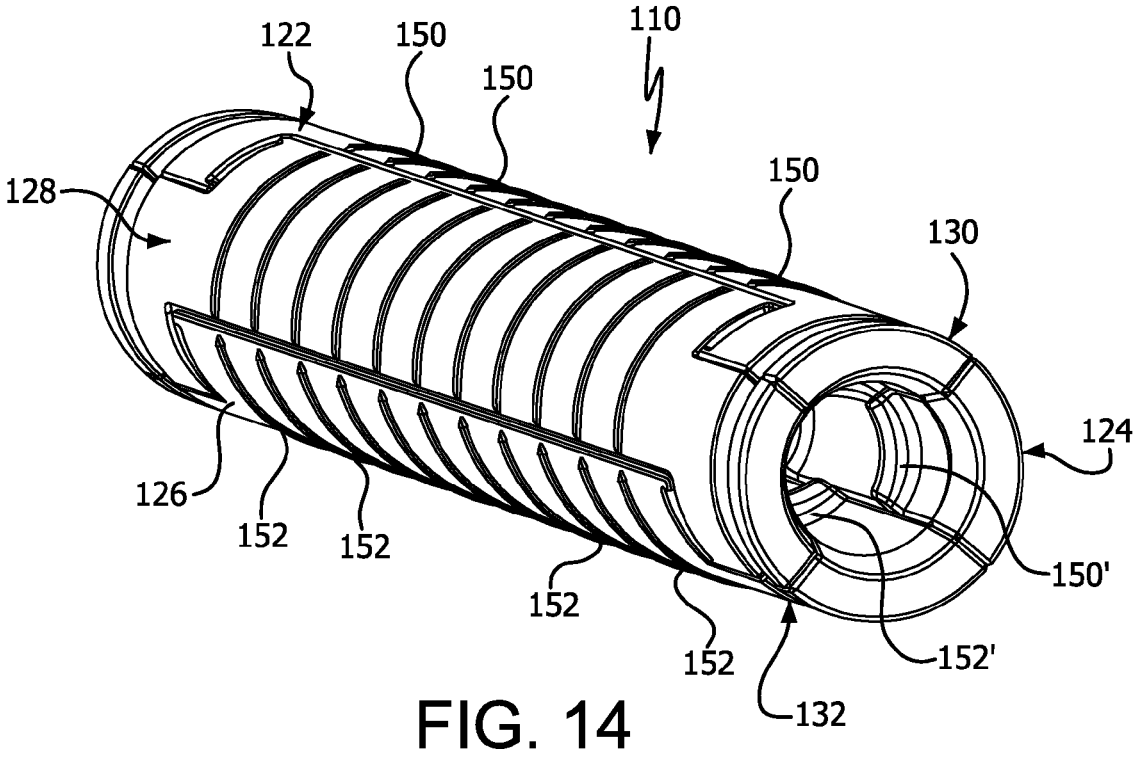
FIG. 14 is a front perspective view of the wave gripping core sleeve according to a second exemplary embodiment of the present invention.
Figure 4:
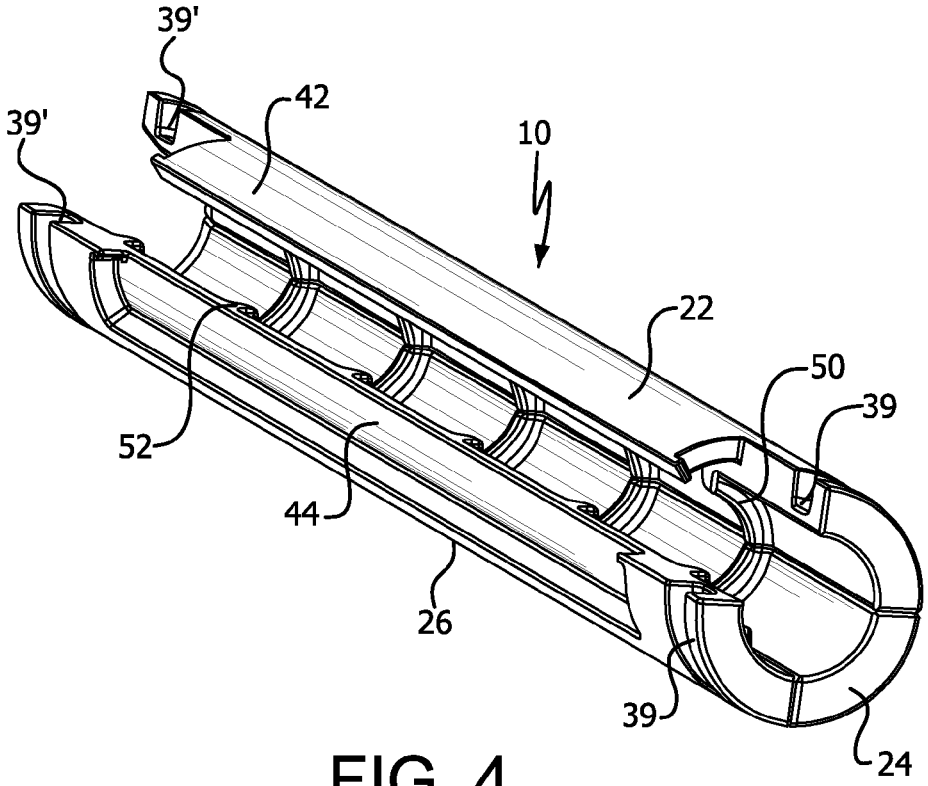
FIG. 4 is a front perspective view of three interlocking members of the wave gripping core sleeve, as seen in FIGS. 1-3.

In an alternative embodiment shown in FIG. 14, the wave gripping core sleeve 110 is similar to that of the first embodiment, however the interlocking members 122, 124, 126, 128 of the wave gripping core sleeve 110 further include a plurality of ribs 150, 152 along their exterior surface. The exterior ribs 150, 152 are axially offset the same way as the interior plurality of ribs 150', 152' with a first semi-cylindrical member 130 having a first set of ribs 150 offset from a second set of ribs 152 offset of a second semi-cylindrical member 132. The exterior ribs 150, 152 enhance the attachment of the wave gripping core sleeve 110 with the aluminum sleeve or, in some cases, with an aluminum filler tube.

In another exemplary embodiment, as shown in FIGS. 15-19 and 21, each wing 242 of the wave gripping core sleeve 210 includes a projection lock or locking finger 260 at its respective outer end for engaging a mating projection lock or locking finger 262 on the corresponding receptacle 244. Each locking finger 260 projects into the receptacle 244 of the adjacent interlocking member and prevents the diameter of the core sleeve from expanding.

Figure 20:
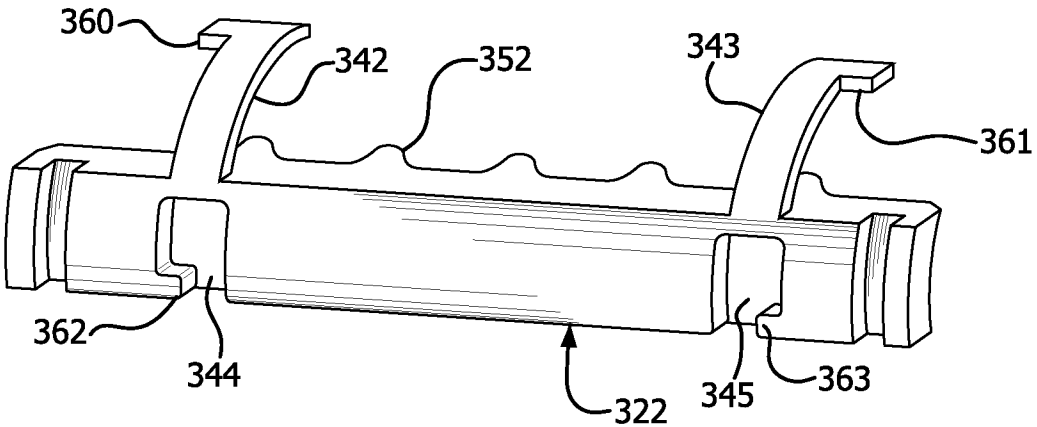
FIG. 20 is a perspective view of an interlocking member of a wave gripping core sleeve according to another exemplary embodiment in which each interlocking member has a pair of wings and a pair of receptacles.
Figure 21:
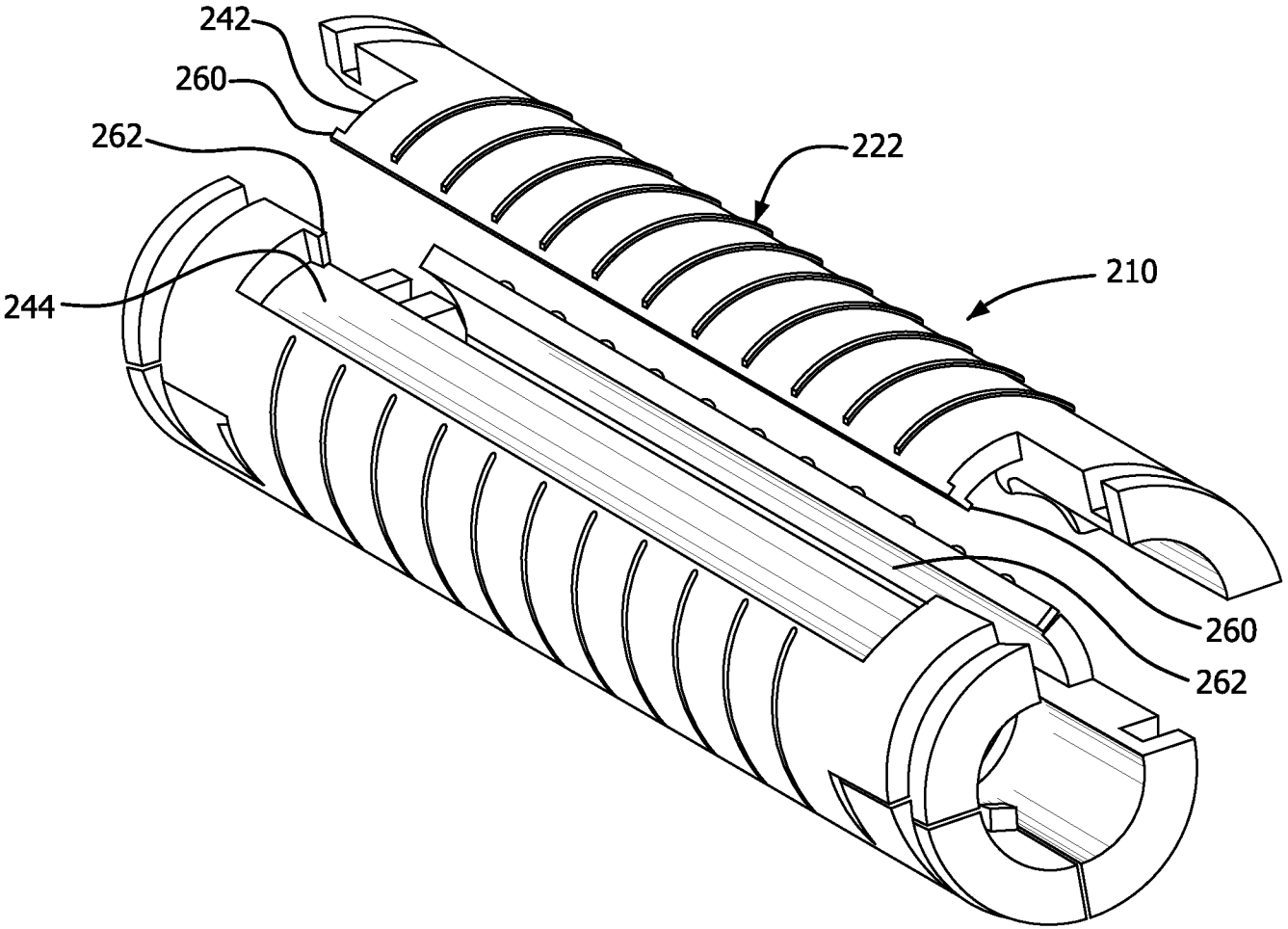
FIG. 21 is an exploded perspective view of the wave gripping core sleeve of FIGS. 15-18.

Another exemplary embodiment of an interlocking member 322 for a wave gripping core sleeve is shown in FIG. 20. The interlocking member 322 is similar to the wave gripping core member 222 of FIGS. 15-19 except that the interlocking member 322 has first and second wings 342 and 343. Each of the first and second wings has a projection lock or locking finger 360 and 361. Corresponding first and second receptacles 344 and 345 receive the locking fingers 360 and 361 from the adjacent interlocking member. A projection lock or locking finger 362 and 363 projects into the first and second receptacle 344 and 345, respectively, and prevents the adjacent and engaged interlocking members from separating. Ribs 352 can be formed on an inner surface of each interlocking member 322.

Figure 22:
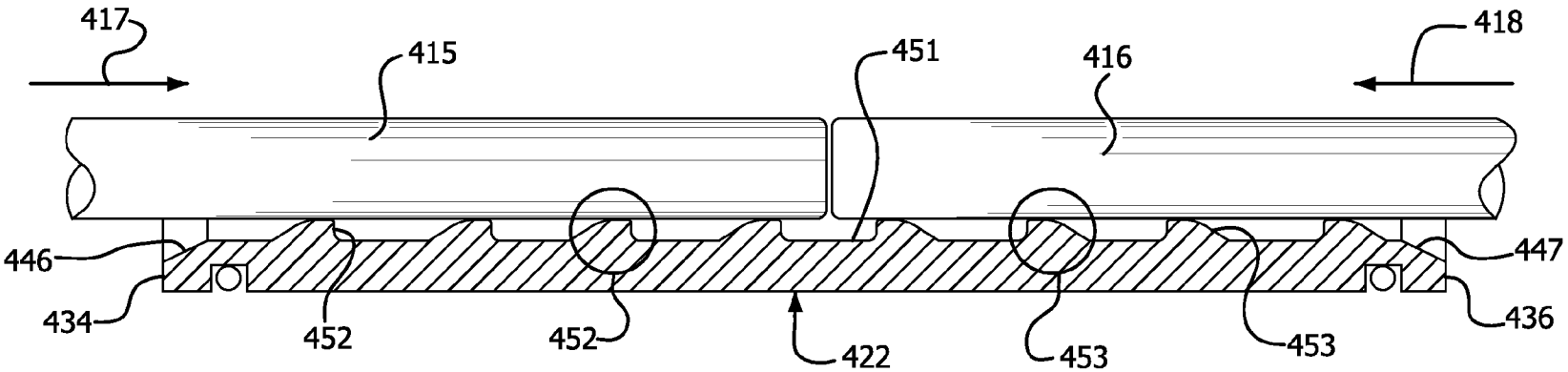
FIG. 22 is an elevational view in cross section of an interlocking member of a wave gripping core sleeve for a full tension joint for joining ends of two conductors according to another exemplary embodiment.
Figure 23:
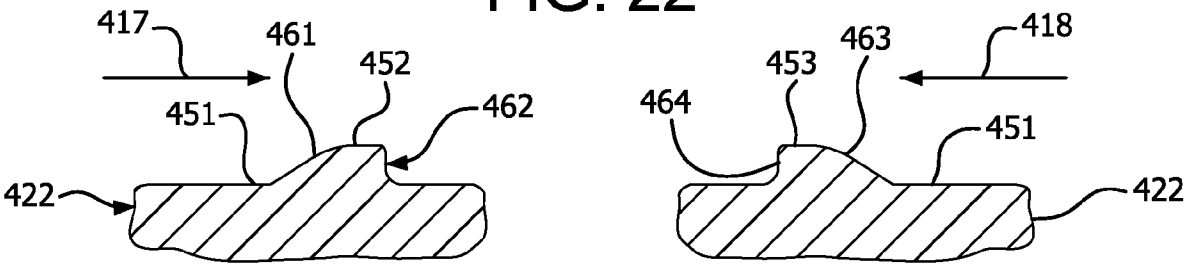
FIG. 23 is an enlarged elevational view in cross section of first and second ribs on an inner surface of the interlocking member of FIG. 22 in which the first and second ribs are sloped in different directions.

In another exemplary embodiment shown in FIGS. 22 and 23, an interlocking member 422 of a wave gripping core sleeve receives first and second steel cores 415 and 416, such as for forming a full tension joint. The wave gripping core of FIGS. 22 and 23 is substantially similar to the wave gripping cores of the previously described exemplary embodiments except for the following noted features. Ramped surfaces 446 and 447 are formed at the first and second end 434 and 436, respectively, to facilitate insertion of the first and second steel cores 415 and 416 into the wave gripping core sleeve. The insertion direction of the first steel core 415 is indicated by arrow 417, and the insertion direction of the second steel core 416 is indicated by arrow 418.

First and second ribs 452 and 453 are formed on an inner surface 451 of each interlocking member 422. The first ribs 452 are disposed on a section of the inner surface 451 over which the first steel core 415 extends, as shown in FIG. 22. Each of the first ribs 452 has a sloped surface 461 facing the side of the wave gripping core through which the first steel core 415 is inserted, as shown in FIG. 23. Each of the first ribs 452 has a stopping surface 462 that is substantially perpendicular to the inner surface 451. The stopping surface 462 substantially prevents movement of the first steel core 415 in a direction opposite to the insertion direction.

The second ribs 453 are disposed on a section of the inner surface 451 over which the second steel core 416 extends, as shown in FIG. 22. Each of the first ribs 452 has a sloped surface 463 facing the side of the wave gripping core through which the second steel core 416 is inserted, as shown in FIG. 23. Each of the second ribs 453 has a stopping surface 464 that is substantially perpendicular to the inner surface 451. The stopping surface 464 substantially prevents movement of the second steel core 416 in a direction opposite to the insertion direction.

Figure 24:
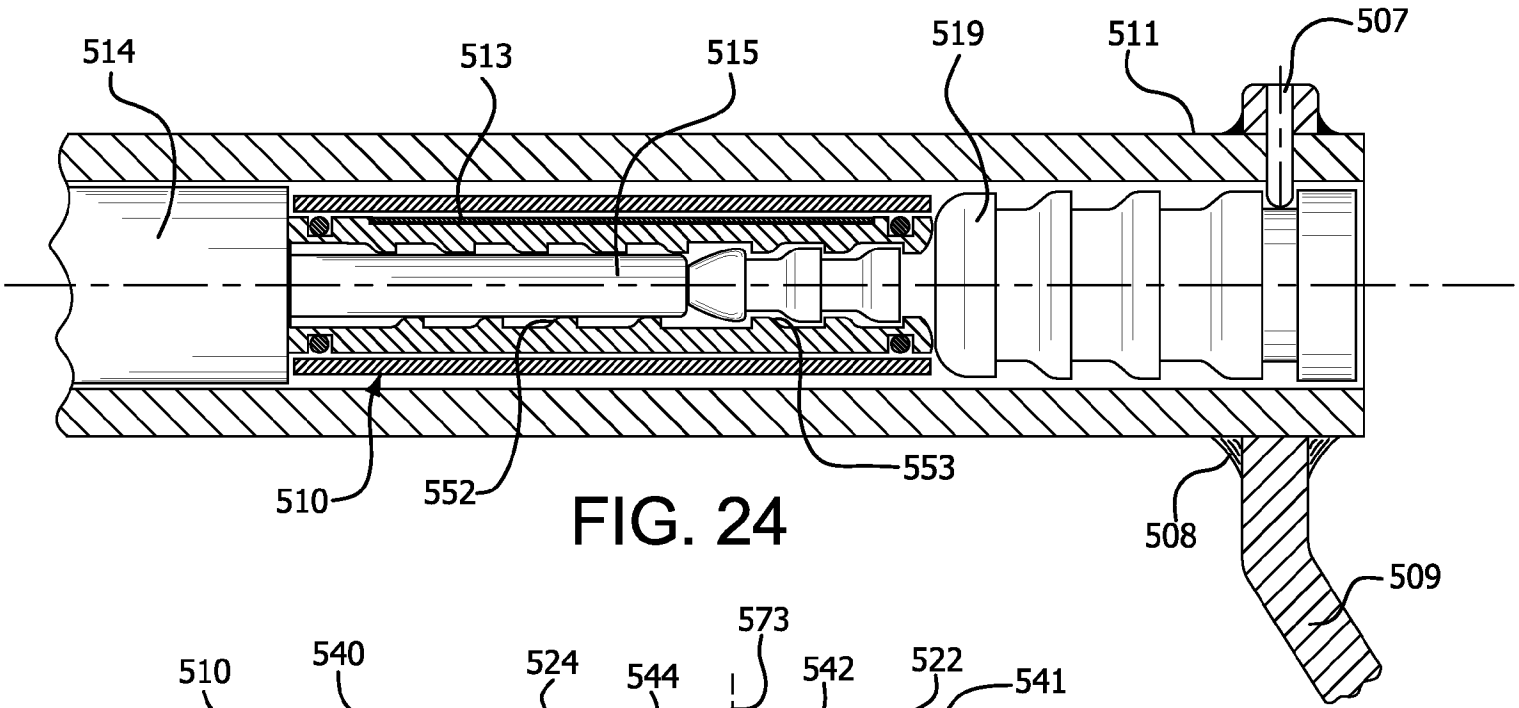
FIG. 24 is an elevational view in cross section of a wave gripping core sleeve according to another exemplary embodiment.
Figure 25:
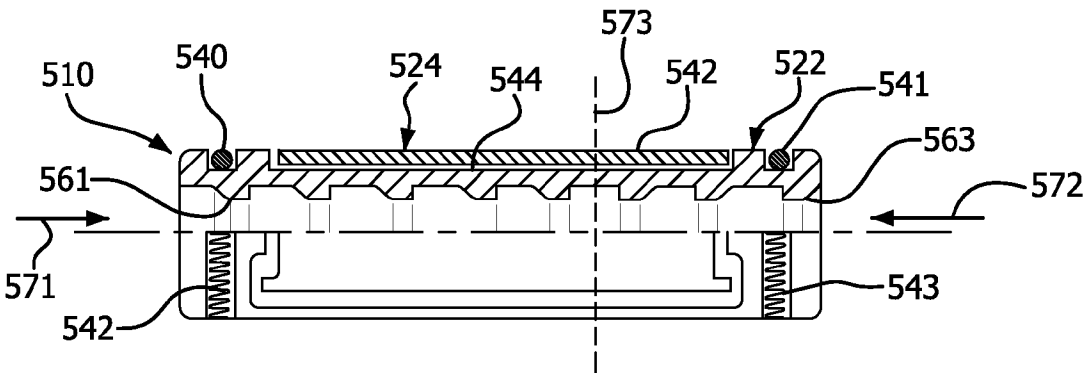
FIG. 25 is an elevational view in partial cross section of the wave gripping core sleeve of FIG. 24.

In another exemplary embodiment, as shown in FIGS. 24 and 25, a wave gripping core sleeve 510 is used with a hydraulic crimping connector. The wave gripping core sleeve 510 is substantially similar to the wave gripping core sleeves of the above-described exemplary embodiments, except for the following noted features. The wave gripping core sleeve 510 receives a steel core 515 of a conductor 514 and an eye bolt 519. A filler tube 513 can be disposed over the wave gripping core sleeve 510 to provide the wave gripping core sleeve with an outer diameter substantially equivalent to that of the conductor 514 and the eyebolt 519, as shown in FIG. 24. If the outer diameter of the wave gripping core sleeve 510 is substantially equivalent to the outer diameter of the conductor 514 and the eyebolt 519, then a filler tube is not required. Preferably, the filler tube 513 is made of aluminum. The wave gripping core sleeve 510, the eyebolt 519 and the conductor 514 are disposed within a tube 511, which is connected to a terminal pad 509. Welding joints 508 can be used to facilitate securing the tube 511 to the pad 509. A locking pin 507 is inserted through the tube 511 and engages the eyebolt 519 to prevent axial movement of the eyebolt within the tube while allowing for rotation of the eyebolt within the tube. Preferably, the tube 511 is made of annealed aluminum to facilitate die crimping.

First and second ribs 552 and 553 are disposed on an inner surface 551 of each interlocking member 522. The first ribs 552 have a sloped surface 561 facing the end of the wave gripping core sleeve through which the steel core 515 is inserted. The insertion direction of the steel core 515 is indicated by the arrow 571. The second ribs 553 have a sloped surface 563 facing the end of the wave gripping core sleeve through which the eyebolt 519 is inserted. The insertion direction of the eyebolt 519 is indicated by the arrow 572. A stopping plane 573 indicates the point at which ends of the steel core 515 and the eyebolt 519 engage within the wave gripping core sleeve 510, as well as the transition point between the first and second ribs 552 and 553.

As in the above-described exemplary embodiments of the wave gripping core sleeve, a recess 544 of an interlocking member 522 receives a wing 542 of an adjacent interlocking member. Spring members 540 and 541, such as garter springs, are disposed in grooves 542 and 543 formed at opposite ends of the wave gripping core sleeve 510.

The wave gripping core sleeves described above can also be used in hydraulic compression splices, automatic splice connectors, and related industries.

While various embodiments have been chosen to illustrate the invention, it will be understood by those skilled in the art that various changes and modifications can be made therein without departing from the scope of the invention as defined in the appended claims.

What is claimed is:

1. A wave gripping core sleeve comprising:

a plurality of interlocking members, each interlocking member having a first axial end and a second axial end with a groove disposed adjacent at least one of the first and second ends thereof, a first longitudinal side extending between the first and second axial ends and having an integral protrusion extending outwardly therefrom and a second longitudinal side opposite the first longitudinal side and having a recessed opening therein, the second longitudinal side of a first interlocking member being engaged with the first longitudinal side of a second interlocking member adjacent the first interlocking member such that said integral protrusion of said first interlocking member is directly received by said recessed opening of said interlocking member, the second longitudinal side of the second interlocking member being engaged with the first longitudinal side of a third interlocking member adjacent the second interlocking member such that said integral protrusion of said second interlocking member is directly received by said recessed opening of said third interlocking member, engagements between said protrusions and recessed openings of said adjacent interlocking members allowing for radial movement therebetween while restricting axial movement therebetween to maintain axial alignment therebetween; and at least one resilient member wrapped around the plurality of interlocking members and received in the grooves thereof.

2. A wave gripping core sleeve according to claim 1, wherein the resilient member is a garter spring.

3. A wave gripping core sleeve according to claim 1, further including a first resilient member is wrapped around the plurality of interlocking members at the first end and a second resilient member is wrapped around the plurality of interlocking members at the second end.

4. A wave gripping core sleeve according to claim 1 further including an angled wall being disposed at the first end of at least one of the plurality of interlocking members.

5. A wave gripping core sleeve according to claim 1 further including a plurality of ribs disposed along an interior surface of at least two of the interlocking members.

6. A wave gripping core sleeve according to claim 1, wherein a first pair of the plurality of members includes a first set of ribs; and a second pair of the plurality of members includes a second set of ribs.

7. A wave gripping core sleeve according to claim 6, wherein the first set of ribs is offset from the second set of ribs along a longitudinal axis of the interlocking members.

8. A wave gripping core sleeve according to claim 7, wherein a conductor steel core is received between the first and second sets of ribs.

9. A wave gripping core sleeve according to claim 1, wherein first and second interlocking members form a first semi-cylindrical member having a first set of ribs along the interior surface thereof; and third and fourth interlocking members form a second semi-cylindrical member having a second set of ribs along the interior surface thereof.

10. A wave gripping core sleeve according to claim 9, wherein the first set of ribs is offset from the second set of ribs along a longitudinal axis of the interlocking members.

11. A wave gripping core sleeve according to claim 10, wherein the first set of ribs moves a conductor in a first direction and the second set of ribs moves the conductor in a second direction substantially opposite from the first direction.

12. A wave gripping core sleeve according to claim 1, further including a first plurality of ribs disposed along an interior surface of at least one of the interlocking members and having a first sloped surface facing a first direction; and a second plurality of ribs disposed along the interior surface of the at least one interlocking member and having a second sloped surface facing a second direction.

13. A wave gripping core sleeve, comprising:

a plurality of interlocking members having first and second longitudinally extending sides disposed between first and second axial ends thereof, an integral protrusion extending outwardly from each said first longitudinally extending side and a recessed opening in each said second longitudinally extending side, wherein the first longitudinally extending side of a first member being engaged with the second longitudinally extending side of a second member such that said integral protrusion of said first interlocking member is directly received by said recessed opening of said second interlocking member, engagements between said protrusions and recessed openings of said adjacent interlocking members allowing for radial movement therebetween while restricting axial movement therebetween to maintain axial alignment therebetween;

a first set of semi-annularly extending ribs disposed on the interior surface of first and second interlocking members;

a second set of semi-annularly extending ribs disposed on the interior surface of third and fourth interlocking members, the second set of semi-annularly extending ribs being offset from the first set of semi-annularly extending ribs along a longitudinal axis of the interlocking members;

a resilient member wrapped around at least two of the interlocking members; and a conductor steel core received between the plurality of interlocking members.

14. A wave gripping core sleeve according to claim 13, wherein the exterior surface of a first interlocking member includes a first set of external ribs located thereon; and the exterior surface of a second interlocking member includes a second set of external ribs located thereon, the second set of external ribs being offset from the first set of external ribs along a longitudinal axis of the interlocking members.

15. A wave gripping core sleeve according to claim 14, wherein the first set of semi-annularly extending ribs engages the conductor in a first direction; and the second set of semi-annularly extending ribs engages the conductor in a second direction, the second direction being opposite the first direction.

16. A wave gripping core sleeve according to claim 13, wherein the first longitudinally extending side includes a first projection lock; and the second longitudinally extending side includes a second projection lock adapted to receive the first projection lock.

17. A wave gripping core sleeve according to claim 1, wherein first and second integral protrusions extend from opposite axial ends of each of said first longitudinal sides.

18. A wave gripping core sleeve according to claim 1, wherein said integral protrusion is substantially centered on said first longitudinal side.

19. A wave gripping core sleeve according to claim 13, wherein first and second integral protrusions extend from opposite axial ends of each of said first longitudinal sides.

20. A wave gripping core sleeve according to claim 13, wherein said integral protrusion is substantially centered on said first longitudinal side.

* * * * *